US007316544B2

(12) United States Patent
Vidrine

(10) Patent No.: US 7,316,544 B2
(45) Date of Patent: Jan. 8, 2008

(54) AUTOMATIC PNEUMATIC PUMP

(76) Inventor: James D. Vidrine, 260 Boudar Dr., Opelousas, LA (US) 70570

( * ) Notice: Subject to any disclaimer, the term of this patent is extended or adjusted under 35 U.S.C. 154(b) by 618 days.

(21) Appl. No.: 10/762,291

(22) Filed: Jan. 23, 2004

(65) Prior Publication Data

US 2005/0163629 A1 Jul. 28, 2005

(51) Int. Cl.
*F04F 1/06* (2006.01)
*F04F 3/00* (2006.01)

(52) U.S. Cl. ..... 417/126; 417/118

(58) Field of Classification Search ..... 137/206, 137/209, 433; 417/118, 126, 134, 234, 384, 417/394, 137, 138; 166/68, 372
See application file for complete search history.

(56) References Cited

U.S. PATENT DOCUMENTS 2,199,673 A * 5/1940 Ronning ..... 137/247.17
3,299,818 A * 1/1967 Meyer ..... 137/433
4,257,751 A 3/1981 Kofahl
4,844,699 A * 7/1989 Hoppmann et al. ..... 417/134
5,004,405 A 4/1991 Breslin
5,141,404 A 8/1992 Newcomer et al.
5,148,827 A * 9/1992 Masters ..... 137/209
5,451,144 A 9/1995 French
5,662,460 A 9/1997 Modesitt
5,944,490 A 8/1999 Breslin
6,027,314 A 2/2000 Breslin
6,092,547 A * 7/2000 Komiya et al. ..... 137/192
6,099,735 A * 8/2000 Kelada ..... 210/652
6,224,343 B1 5/2001 Newcomer
6,435,838 B1 * 8/2002 Marvel et al. ..... 417/53
6,602,055 B1 * 8/2003 Thurot et al. ..... 417/118
2002/0172600 A1 * 11/2002 Anderson ..... 417/118

* cited by examiner

*Primary Examiner*—Devon C. Kramer
*Assistant Examiner*—Peter J Bertheaud
(74) *Attorney, Agent, or Firm*—Richard C. Litman

(57) ABSTRACT

An automatic, pneumatic pump having a chamber that is gravity fed through a top opening and through a vertical tube with waste liquid. A buoyant plunger sits on an air inlet nipple, which nipple is located at the bottom of the chamber. Liquid entering the chamber causes the plunger to float and thereby to be unseated from the air inlet nipple. The plunger rises in the tube until it closes the top opening. Pressurized air enters the chamber and forces the waste liquid out through a discharge line. When all air and liquid have been discharged, the plunger falls to the bottom of the tube and reseats on the air inlet nipple so that the cycle can start again.

17 Claims, 5 Drawing Sheets

AUTOMATIC PNEUMATIC PUMP

BACKGROUND OF THE INVENTION

1. Field of the Invention

The present invention generally relates to pumps. More specifically, the present invention is drawn to a pneumatically-operated fluid pump.

2. Description of the Related Art

Environmental concerns have dictated that fluid-contaminated sites must be cleaned. The contaminated sites may include land rig cellars and pits that are filled with slush and oilfield mud. Federal and state laws often mandate that this contaminated, liquid material be removed for destruction. Removal of the contaminated material requires the use of a sturdy, reliable liquid pump. A variety of pumps have been employed in the past for removing liquid contaminates. For example, U.S. Pat. No. 5,451,144 (French), U.S. Pat. No. 5,662,460 (Modesitt), U.S. Pat. No. 5,944,490 (Breslin), U.S. Pat. No. 6,224,343 B1 (Newcomer) and U.S. Pat. No. 5,004,405 (Breslin) disclose pneumatically operated pumps utilized to pump fluids. All of the disclosed pumps employ relatively complicated bellows and/or linkage systems, which systems are subject to operational wear and tear and require maintenance.

U.S. Pat. No. 4,257,751 (Kofahl) and U.S. Pat. No. 5,141,404 (Newcomer) show down hole pumps adapted for placement in a well bore. The pumps include coiled springs that will lose resiliency after repeated use.

U.S. Pat. No. 6,027,314 (Breslin) discloses a submerged pump that relies on plural valves to accomplish its function.

None of the above inventions and patents, taken either singly or in combination, is seen to disclose a pneumatically operated pump as will subsequently be described and claimed in the instant invention.

SUMMARY OF THE INVENTION

The present invention is an automatic, pneumatic pump having a chamber that is gravity-fed through a top opening and through a vertical tube with waste liquid. A buoyant plunger sits on an air inlet nipple, which nipple is located at the bottom of the chamber. Liquid entering the chamber causes the plunger to float and thereby to be unseated from the air inlet nipple. The plunger rises in the tube until it closes the top opening. Pressurized air enters the chamber and forces the waste liquid out through a discharge line. When substantially all air and liquid have been discharged, the plunger falls to the bottom of the tube and reseats on the air inlet nipple so that the cycle can start again.

Accordingly, it is a principal object of the invention to provide a pneumatic pump, which pump is adapted to pump contaminated wastes out of land rig cellars and pits.

It is another object of the invention to provide a pneumatic pump, which pump is automatically operated.

It is a further object of the invention to provide a pneumatic pump, which pump is maintenance free.

Still another object of the invention is to provide a pneumatic pump, which pump requires only one moving part.

It is an object of the invention to provide improved elements and arrangements thereof for the purposes described which are inexpensive, dependable and fully effective in accomplishing their intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
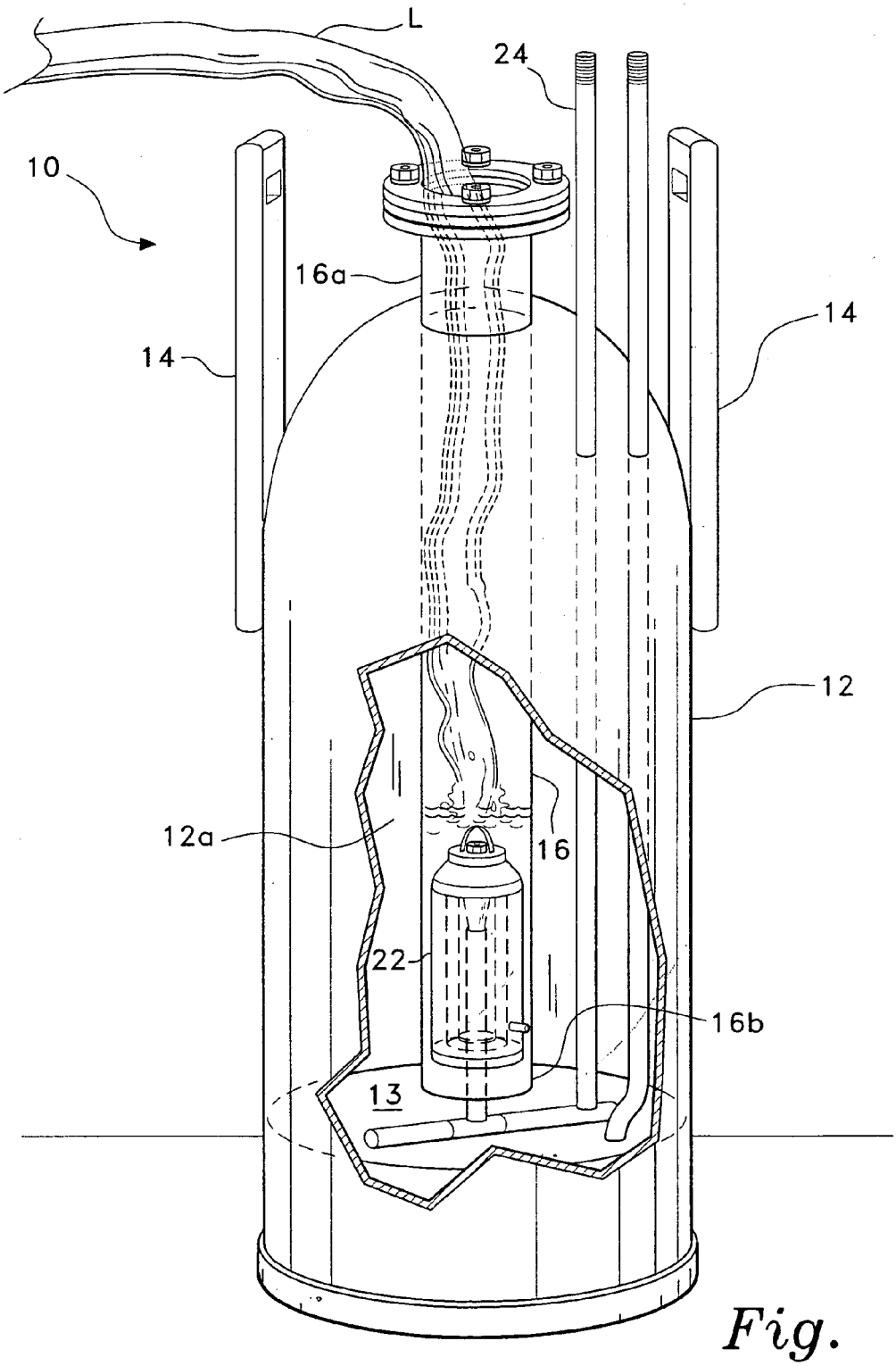
FIG. 1 is an environmental view of an automatic pneumatic pump according to the present invention with the plunger seated on the air inlet stem.
Figure 2:
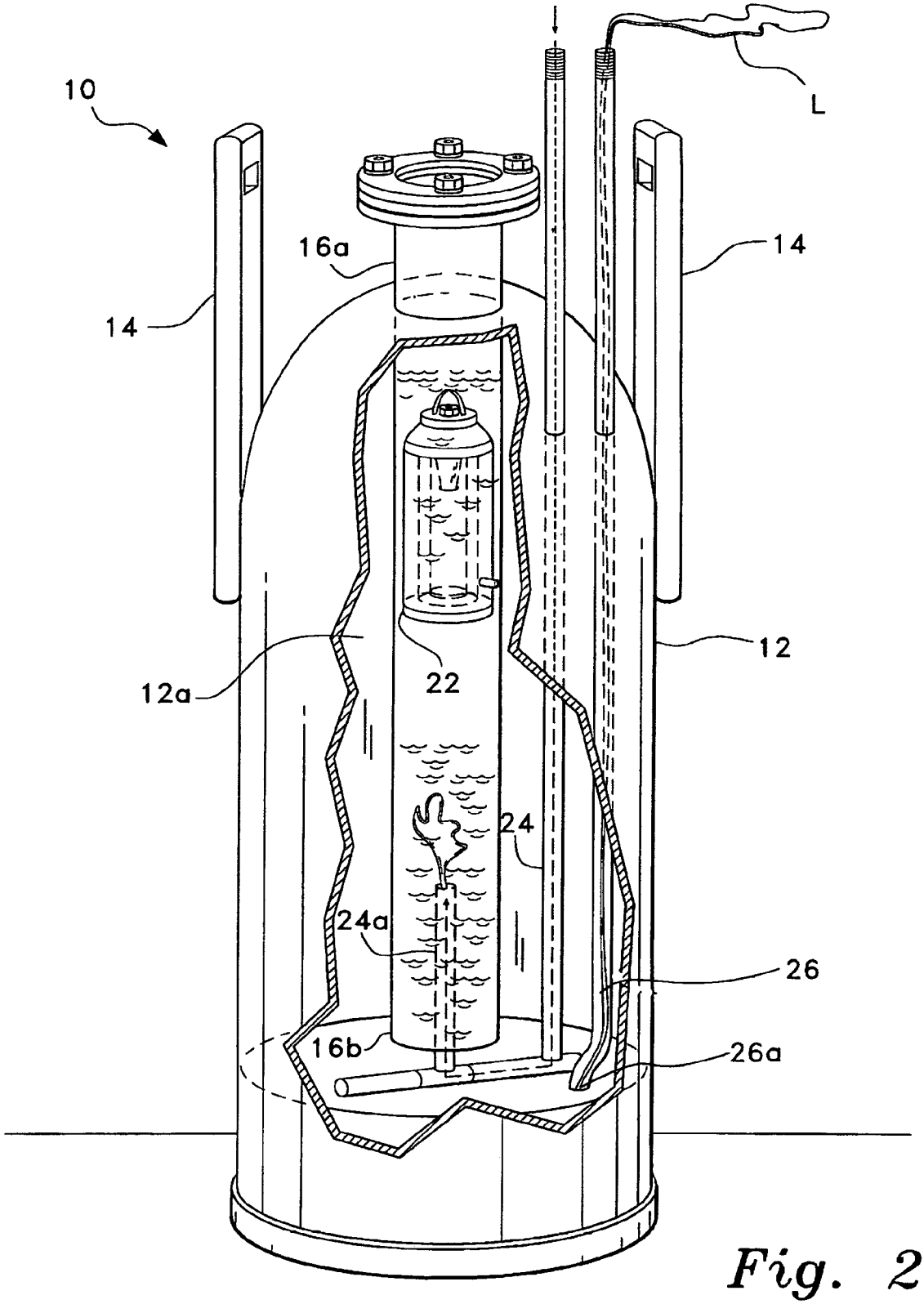
FIG. 2 is an environmental view of an automatic pneumatic pump according to the present invention with the plunger afloat and unseated from the air inlet stem.
Figure 3:
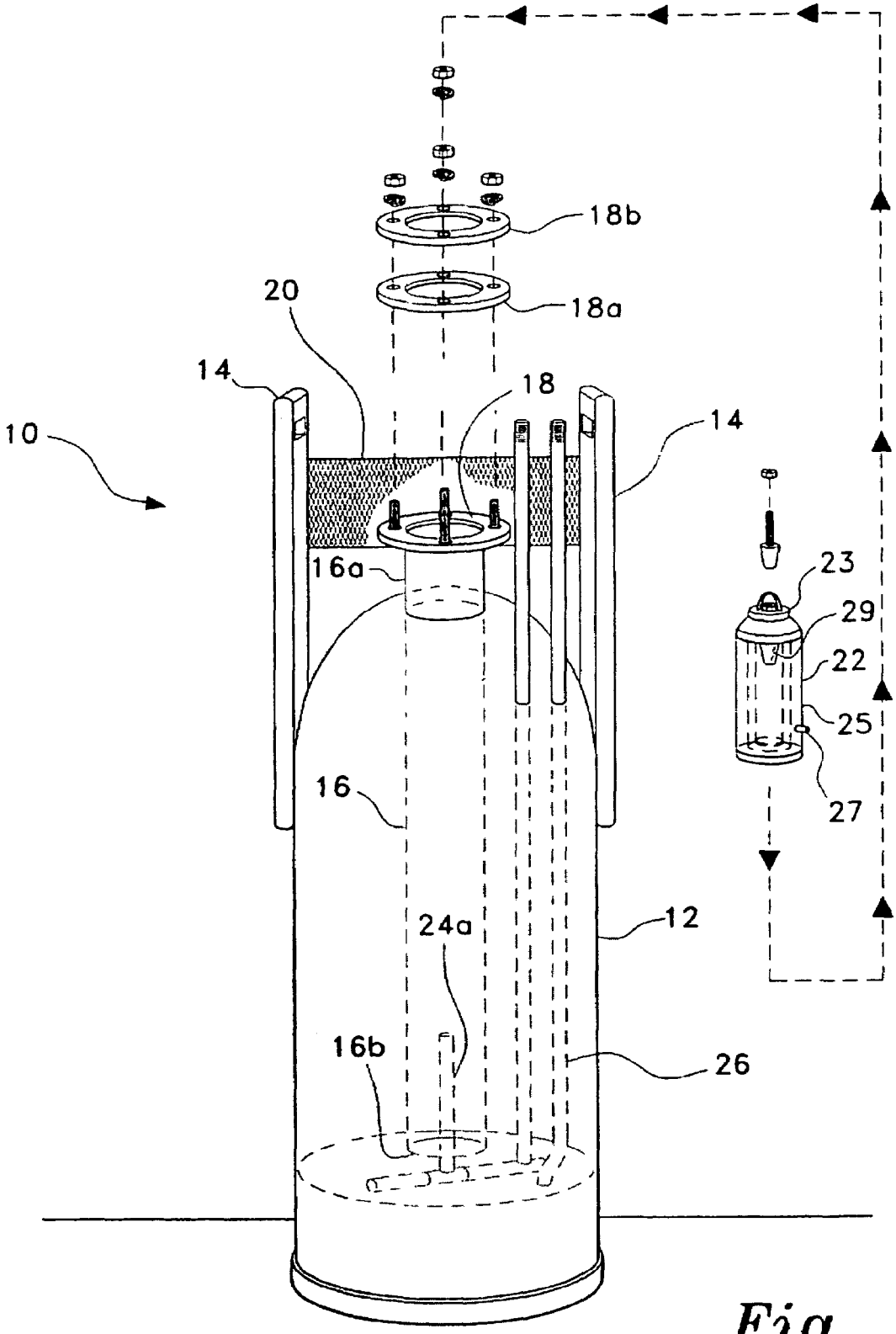
FIG. 3 is an exploded view of an automatic pneumatic pump according to the present invention.
Figure 5:
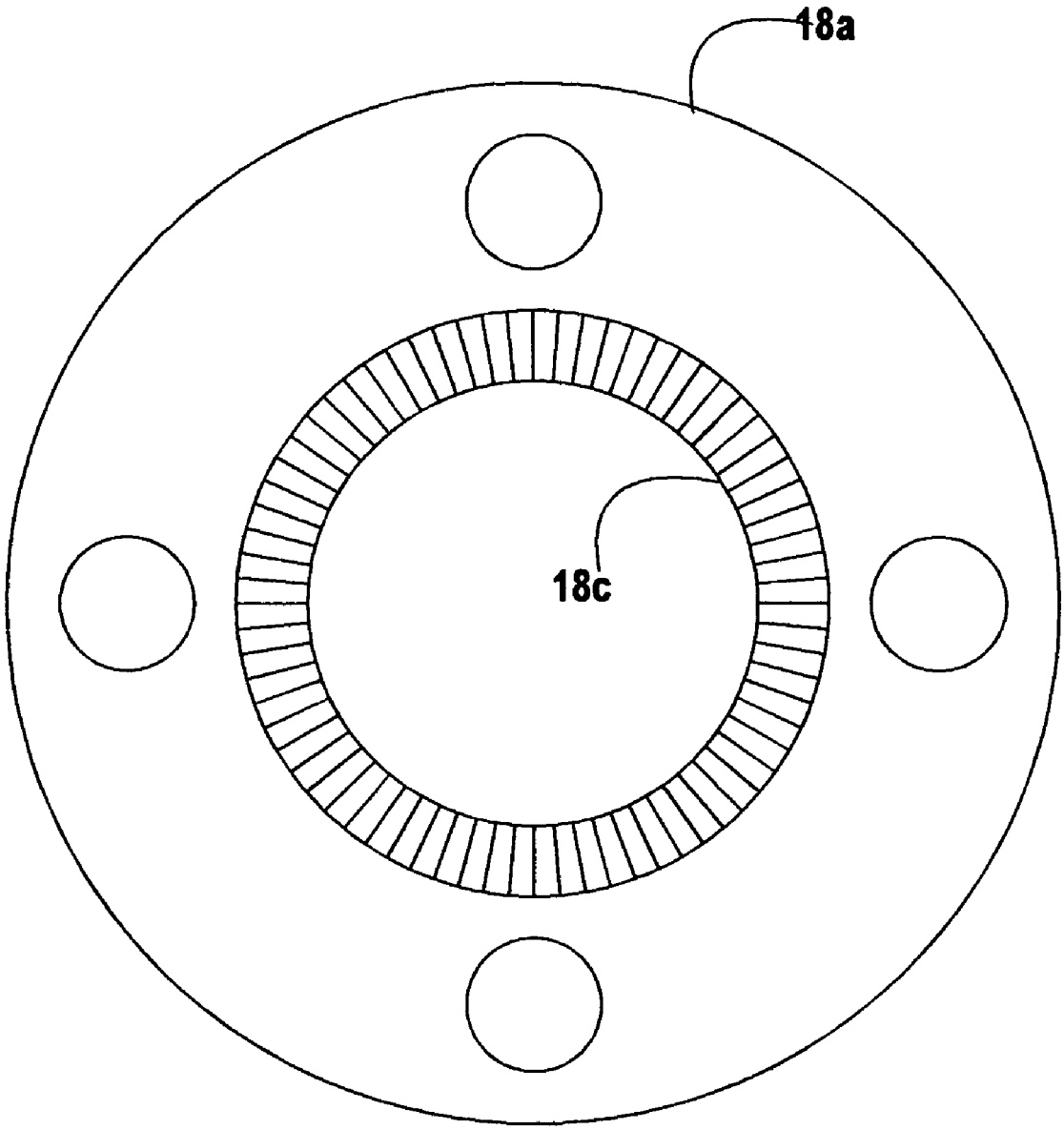
FIG. 5 is a bottom view of a head plate gasket according to the present invention.

Attention is directed to FIGS. 1-3 wherein the pump of the present invention is generally indicated at 10. Pump 10 comprises an outer tank 12 made of metallic material, preferably iron or stainless steel, and enclosing a chamber 12*a*. Tank 12 is provided with handle members 14 welded or suitably attached thereto. A tubular member 16 is enclosed within tank 12 and sealed therein. Tube 16 is open at both its upper end 16*a* and its lower end 16*b*. Upper end 16*a* extends though the top of tank 12 and is sealed therewith. A bottom wall 13 seals chamber 12*a* in a water-tight manner. A head seat 18 is attached to end 16*a*. Filter member 20 is positioned over the open upper end of tubular member 16 to prevent large pieces of debris from entering the pump. Head plate gasket 18*a* and head plate 18*b* complete the construction of the upper end. A floatable plunger 22 is disposed within tubular member 16 and is free to move vertically therein. A compressed air line 24 is provided with a removable jet outlet nipple 24*a* that opens into the lower end 16*b* of tube 16. A portion of air line 24 is disposed on the bottom wall 13 of tank 12. At its exterior end air line 24 is connected to a source of compressed air (not shown). A liquid discharge line 26 opens into chamber 12*a* via opening 26*a* adjacent bottom wall 13. As shown in FIG. 1, plunger 22 is seated on jet air outlet nipple 24*a* to prevent air from entering tube 16. Liquid L to be pumped enters tube 16 via open end 16*a*. The rising liquid L causes the plunger to be buoyant enough such that the air pressure pushes the plunger upward toward end 16*a* (FIG. 2). The top of plunger 22 is provided with a gasket or the like 23 for sealing engagement with head seat 18. Head plate gasket 18*a* is provided with a beveled surface 18*c* on its under side (FIG. 5) so that the top of the plunger can form a tight seal therewith. This arrangement will allow the plunger to prevent the flow of liquid into tube 16 when the plunger has risen to the top of member 16. When the plunger begins to move upward it becomes disengaged from nipple 24*a* thereby allowing compressed air to enter tube 16 and chamber 12*a*. The continued entry of compressed air forces the liquid through discharge line 26. When substantially all air and liquid has been discharged, plunger 22 falls and is reseated on nipple 24*a* to begin another pumping cycle.

Figure 4:
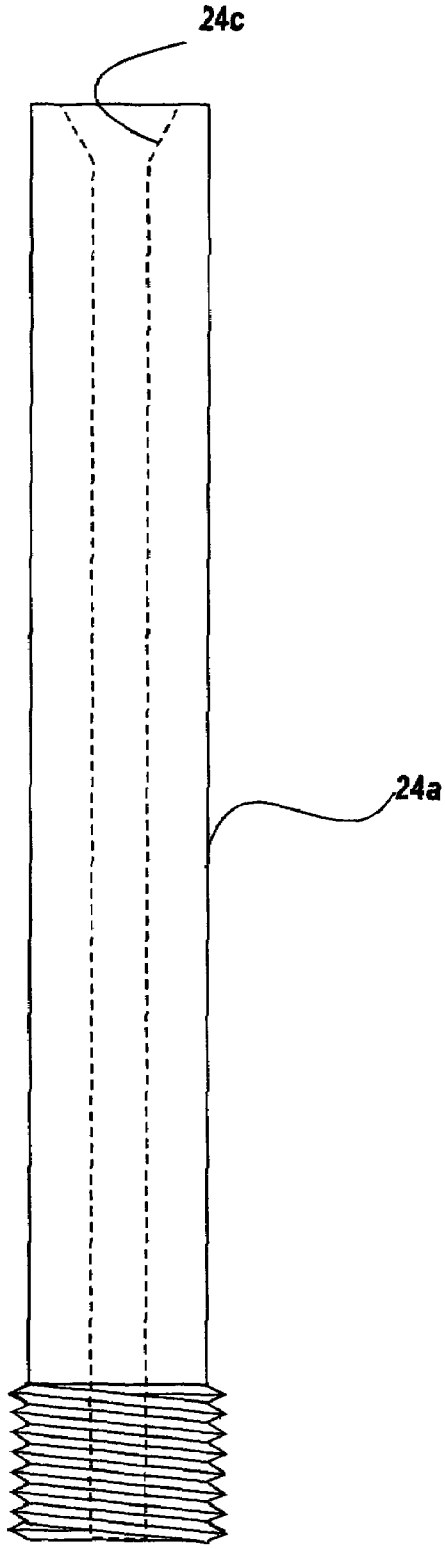
FIG. 4 is a side view of a jet nipple according to the present invention.

As best seen in FIG. 3, plunger 22 is a generally cylindrical member having an open bottom. Plunger 22 is made of iron. A double-walled configuration provides a sealed chamber 25 between the outer and inner walls. A sealable opening 27 is disposed in the outer wall. This arrangement permits a user to inject a fluid into chamber 25 to increase the weight of the plunger, if necessary, for more efficient pumping. A sealing plug 29 is provided to engage outlet 24*a* when the plunger is seated thereon. Plug 29 is fabricated from a pliable material such as rubber. As best seen in FIG. 4 jet outlet nipple 24*a* is threaded at its lower end so that it may be removably inserted into air line 24. Nipple 24*a* is fabricated with a conical seat 24*c* to receive plug 29 in sealing engagement.

It is to be understood that the present invention is not limited to the embodiment described above, but encompasses any and all embodiments within the scope of the following claims.

I claim:

1. An automatic pneumatic pump, comprising:

a casing, said casing having an outer surface, a top wall and a bottom wall, said casing, top wall and bottom wall enclosing a water-tight chamber;

a cylindrical tube disposed in said casing, said tube having an open upper end and an open lower end, wherein said open upper end extends above the top wall of said casing;

a compressed air line, said air line having a portion disposed on said bottom wall;

an outlet nipple having a conical outlet opening connected to said air line, said nipple extending through said open lower end of said tube;

a fluid discharge line, said discharge line having an inlet opening into said water-tight chamber; and a plunger, said plunger disposed in said tube and freely movable therein.

2. An automatic pneumatic pump as recited in claim 1, including a head gasket seat and a beveled head plate gasket disposed on said open upper end.

3. An automatic pneumatic pump as recited in claim 2, including a gasket on said plunger, wherein said gasket engages said head gasket seat and said beveled head plate gasket to close said open upper end.

4. An automatic pneumatic pump as recited in claim 1, including a pair of lifting handles attached to the outer surface of said casing.

5. An automatic pneumatic pump as recited in claim 1, including a plug in said plunger for engaging said nipple and sealing said outlet.

6. An automatic pneumatic pump as recited as recited in claim 1, including a filter positioned at said open upper end.

7. An automatic pneumatic pump as recited in claim 1, wherein said plunger comprises:

a cylindrical member having double walls, an open bottom, and a closed top;

a fluid-tight annular chamber defined between said double walls;

a tubular passageway vertically disposed in said plunger, said passageway extending from said open bottom to said closed top; and a plug for sealing said outlet nipple, said plug positioned in said passageway adjacent said closed top.

8. An automatic pneumatic pump as recited in claim 7, wherein said plug is fabricated from a pliable material.

9. An automatic pneumatic pump as recited in claim 7, wherein said plunger is fabricated from iron.

10. An automatic pneumatic pump as recited in claim 7, including a sealable opening positioned in one of said double walls, said opening communicating with said annular chamber.

11. An automatic pneumatic pump, comprising:

a casing, said casing having an outer surface, a top wall and a bottom wall, said casing, top wall and bottom wall enclosing a water-tight chamber;

a cylindrical tube disposed in said casing, said tube having an open upper end and an open lower end, wherein said open upper end extends above the top wall of said casing;

a head gasket seat disposed on said open upper end;

a compressed air line, said air line having a portion disposed on said bottom wall;

an outlet nipple connected to said air line, said nipple extending through said open lower end of said tube;

a fluid discharge line, said discharge line having an inlet opening into said water-tight chamber;

a plunger, said plunger disposed in said tube and freely movable therein; and a pair of lifting handles attached to said outer surface of said casing.

12. An automatic pneumatic pump as recited in claim 11, including a gasket on said plunger, wherein said gasket engages said head gasket seat to close said open upper end.

13. An automatic pneumatic pump as recited in claim 11, including a filter positioned at said open upper end adjacent said head gasket seat.

14. An automatic pneumatic pump as recited in claim 11, wherein said plunger comprises:

a cylindrical member having double walls, an open bottom, and a closed top;

a fluid-tight annular chamber defined between said double walls;

a tubular passageway vertically disposed in said plunger, said passageway extending from said open bottom to said closed top; and a plug for sealing said outlet nipple, said plug positioned in said passageway adjacent said closed top.

15. An automatic pneumatic pump as recited in claim 14, wherein said plug is fabricated from a pliable material.

16. An automatic pump as recited in claim 15, including a sealable opening positioned in one of said double walls, said opening communicating with said annular chamber.

17. An automatic pump as recited in claim 16, wherein said plunger is fabricated from iron.

* * * * *